US011158450B2

(12) United States Patent
Sridhar et al.

(10) Patent No.: US 11,158,450 B2
(45) Date of Patent: Oct. 26, 2021

(54) PARTICLE-BASED, ANISOTROPIC COMPOSITE MATERIALS FOR MAGNETIC CORES

(71) Applicant: International Business Machines Corporation, Armonk, NY (US)

(72) Inventors: Arvind Raj Mahankali Sridhar, Zurich (CH); Thomas Brunschwiler, Thalwil (CH); Suiying Ye, Zurich (CH); Luca Del Carro, Adliswil (CH); Jens Oliver Ammann, Zurich (CH)

(73) Assignee: International Business Machines Corporation, Armonk, NY (US)

( * ) Notice: Subject to any disclaimer, the term of this patent is extended or adjusted under 35 U.S.C. 154(b) by 85 days.

(21) Appl. No.: 16/442,699

(22) Filed: Jun. 17, 2019

(65) Prior Publication Data

US 2020/0395162 A1 Dec. 17, 2020

(51) Int. Cl.
*H01F 27/255* (2006.01)
*H01F 1/22* (2006.01)
(Continued)

(52) U.S. Cl.
CPC ..... *H01F 27/255* (2013.01); *H01F 1/22* (2013.01); *H01F 1/24* (2013.01); *H01F 1/36* (2013.01);
(Continued)

(58) Field of Classification Search
None
See application file for complete search history.

(56) References Cited

U.S. PATENT DOCUMENTS 6,376,393 B1 * 4/2002 Newton ..... A61B 5/1172 438/783
9,230,830 B2 1/2016 Brunschwiler et al.
(Continued)

FOREIGN PATENT DOCUMENTS

CN 204375745 U 6/2015
EP 2146357 B1 1/2010
(Continued)

OTHER PUBLICATIONS

International Search Report dated Sep. 22, 2020 received in PCT/EP2020/065497, 13 pages.
(Continued)

*Primary Examiner* — Kevin M Bernatz
(74) *Attorney, Agent, or Firm* — Scully, Scott, Murphy & Presser, P.C.; Daniel P. Morris, Esq.

(57) ABSTRACT

A magnetic core comprises an anisotropic, composite material, which itself includes a matrix material (e.g., a dielectric, non-magnetic material, preferably a paramagnetic material), and magnetically aligned, ferromagnetic particles. The latter may for instance include micrometer- and/or nanometer-length scale particles. Such particles form chains of particles within the matrix material, wherein the chains form percolation paths of magnetic conduction. The paths extend along a first direction, whereby the chains extend, each, substantially along this first direction, while being distinct and distant from each other along a second direction that is perpendicular to the first direction and, possibly, to a third direction that is perpendicular to both the first direction and the second direction. Necking bridges are preferably formed between the particles. Related devices (e.g., inductor, amplifiers, transformers, etc.) and fabrication methods are also disclosed.

12 Claims, 5 Drawing Sheets

(51) Int. Cl.

| | |
|---|---|
| ***H01F 1/24*** | (2006.01) |
| ***H01F 3/08*** | (2006.01) |
| ***H01F 41/02*** | (2006.01) |
| ***H01F 1/37*** | (2006.01) |
| ***H01F 1/36*** | (2006.01) |

(52) U.S. Cl.
CPC ..... *H01F 1/37* (2013.01); *H01F 3/08* (2013.01); *H01F 41/02* (2013.01); *Y10T 428/32* (2015.01)

(56) References Cited

U.S. PATENT DOCUMENTS

| | | | | |
|---|---|---|---|---|
| 9,337,251 | B2 | 5/2016 | Sturcken | |
| 2008/0292862 | A1* | 11/2008 | Filippov | C04B 35/6263 428/304.4 |
| 2008/0318045 | A1 | 12/2008 | Bose et al. | |
| 2009/0053512 | A1* | 2/2009 | Pyun | G11B 5/712 428/336 |
| 2015/0371756 | A1 | 12/2015 | Sturcken et al. | |
| 2017/0173893 | A1 | 6/2017 | Li et al. | |
| 2020/0082963 | A1* | 3/2020 | Suetsuna | H01F 1/14741 |
| 2020/0331067 | A1* | 10/2020 | Reese | H01F 41/0273 |

FOREIGN PATENT DOCUMENTS

| | | | |
|---|---|---|---|
| WO | 98/06007 | A1 | 2/1998 |
| WO | 2014/001332 | A1 | 1/2014 |

OTHER PUBLICATIONS

Bellaredj, M.L.F., et al., "Fabrication, characterization and comparison of composite magnetic materials for high efficiency integrated voltage regulators with embedded magnetic core micro-inductors", Journal of Physics D: Applied Physics, Received Jun. 7, 2017, Revised Sep. 12, 2017, Accepted for Publication Sep. 15, 2017, Published Oct. 13, 2017, 12 pages, vol. 50.

* cited by examiner

PARTICLE-BASED, ANISOTROPIC COMPOSITE MATERIALS FOR MAGNETIC CORES

BACKGROUND

The present disclosure relates in general to the field of magnetic cores such as used in inductors, amplifiers, transformers, and power-supply devices, as well as such devices, and methods of fabrication of such magnetic cores. In particular, it concerns magnetic cores obtained by aligning ferromagnetic particles into chains by applying a magnetic field.

Magnetic cores are objects made of magnetic materials that have a high magnetic permeability. Such materials are used to confine and guide magnetic fields in a variety of devices. Typically, a magnetic core is used to considerably increase the strength of the magnetic field in an electromagnetic coil. Still, side effects are observed, e.g., in applications such as transformers and inductors, which are notably due to eddy currents (in alternating current devices). This leads to frequency-dependent energy losses. Different fabrication methods have been proposed, which notably rely on laminating thin film magnetic cores, radial magnetic field directed sputtering of thin-film cores, or homogeneously distributed particles (forming a composite for an inductor core).

SUMMARY

According to a first aspect, the present invention is embodied as a magnetic core. The core comprises an anisotropic, composite material, which itself includes a matrix material (e.g., a dielectric, non-magnetic material, or a paramagnetic material), as well as magnetically aligned, ferromagnetic particles. The particles may for instance include micro- and/or nano-particles. They form chains of particles in the matrix material. Such chains form percolation paths of magnetic conduction. The paths extend along a first direction, whereby the chains extend, each, substantially along this first direction. However, the chains remain distinct and distant from each other along a second direction perpendicular to the first direction and, possibly, along a third direction perpendicular to both the first and the second directions. The composite material preferably comprises between 10 and 50 volume percent of ferromagnetic particles. The chains may for instance be substantially arranged according to a parallel line configuration, a configuration of concentric tori, or a racetrack configuration of the chains of particles.

This solution relies on a magnetic assembly of ferromagnetic particles, wherein percolation of particles is imposed in the direction in which the magnetic field is applied during the fabrication, while being suppressed (or mitigated) in a perpendicular direction. This results in enhancing the effective permeability in the direction of the applied magnetic field, while suppressing (or at least mitigating) electrical conduction and thus eddy currents in the perpendicular direction. I.e., the magnetic flux is enhanced along the chain's direction, whereas electrical conduction and thus Eddy currents are reduced in the perpendicular direction. As one may realize, this approach advantageously allows a fast and low-cost fabrication process compared to, e.g., thin-film microfabrication.

Preferably, said particles include first particles (of a first type) and second particles (of a second type), where the second particles have a smaller average diameter than the first particles. For example, the first particles may comprise micrometer-length scale particles, while the second particles may comprise nanometer-length scale particles. The second particles may advantageously be used to form necking bridges between the first particles, bridging the latter along the first direction.

The first and second particles will preferably have an average sintering temperature that is substantially less than a melting temperature of the matrix material, in order to allow a sintering process, to strengthen the mechanical stability of the chains and the magnetic conduction.

According to another but related aspect, the invention is embodied as a magnetic device comprising a magnetic core as described above. The device may notably be an inductor, a transformer, an amplifier, or a power-supply device.

According to another aspect, the invention is embodied as a method of fabrication of a magnetic core as described above. According to this method: a matrix material is provided, which comprises ferromagnetic particles, and a magnetic field is applied so as to magnetically align the ferromagnetic particles in the matrix material and thereby form an anisotropic, composite material for the magnetic core. Consistently with the first aspect of the invention evoked above, this is performed so as to form chains of the particles (e.g., comprising micrometer-length scale particles) within the matrix material, wherein the chains form percolation paths of magnetic conduction extending along a first direction. That is, the chains extend, each, along the first direction, while being distinct and distant from each other along a second direction that is perpendicular to the first direction, as described above. As said too, the ferromagnetic particles introduced in the matrix material may typically represent between 10 and 50 volume percent of the composite material formed.

The applied magnetic field preferably has a strength of at least 20 mT. The magnetic field may notably be applied using permanent magnets and/or an electromagnet. In all cases, the magnetic field may possibly be applied so as for the chains to be arranged according to a parallel line configuration, a configuration of concentric tori, or a racetrack configuration of the chains of particles.

Preferably, the introduced particles comprise first particles (i.e., particles of a first type), as well as second particles (of a second type), wherein the second particles have a smaller average diameter than the first particles. For example, the first particles may comprise micrometer-length scale particles, while the second particles may comprise nanometer-length scale particles, as noted earlier. The method may then comprise forming necking bridges between the first particles, while applying said magnetic field, so as to bridge the first particles thanks to the second particles and, this, along the first direction. The formation of the necking bridges may additionally rely on a sintering process, so as to sinter the first and the second particles.

Eventually, the chains are immobilized in the composite material formed, if necessary, e.g., by cross-linking the matrix material, which can for example be a photopolymer or a thermally curable epoxy. Note, the composite material may possibly be formed by successively forming layers of this composite material, which can be achieved by repeating the method steps described above.

In preferred embodiments, the matrix material is provided in a structured template, so as to constrain the shape of the composite material eventually formed.

For completeness, the magnetic core obtained may finally be integrated in a device, to obtain, e.g., an inductor, an amplifier, or a transformer, a power-supply device, etc.

Devices and methods embodying the present invention will now be described, by way of non-limiting examples, and in reference to the accompanying drawings.

BRIEF DESCRIPTION OF THE DRAWINGS

The accompanying figures, where like reference numerals refer to identical or functionally similar elements throughout the separate views, and which together with the detailed description below are incorporated in and form part of the present specification, serve to further illustrate various embodiments and to explain various principles and advantages all in accordance with the present disclosure, in which:

FIG. 4 depicts a magnetic core exhibiting concentric chains, according to embodiments;

Figure 1:
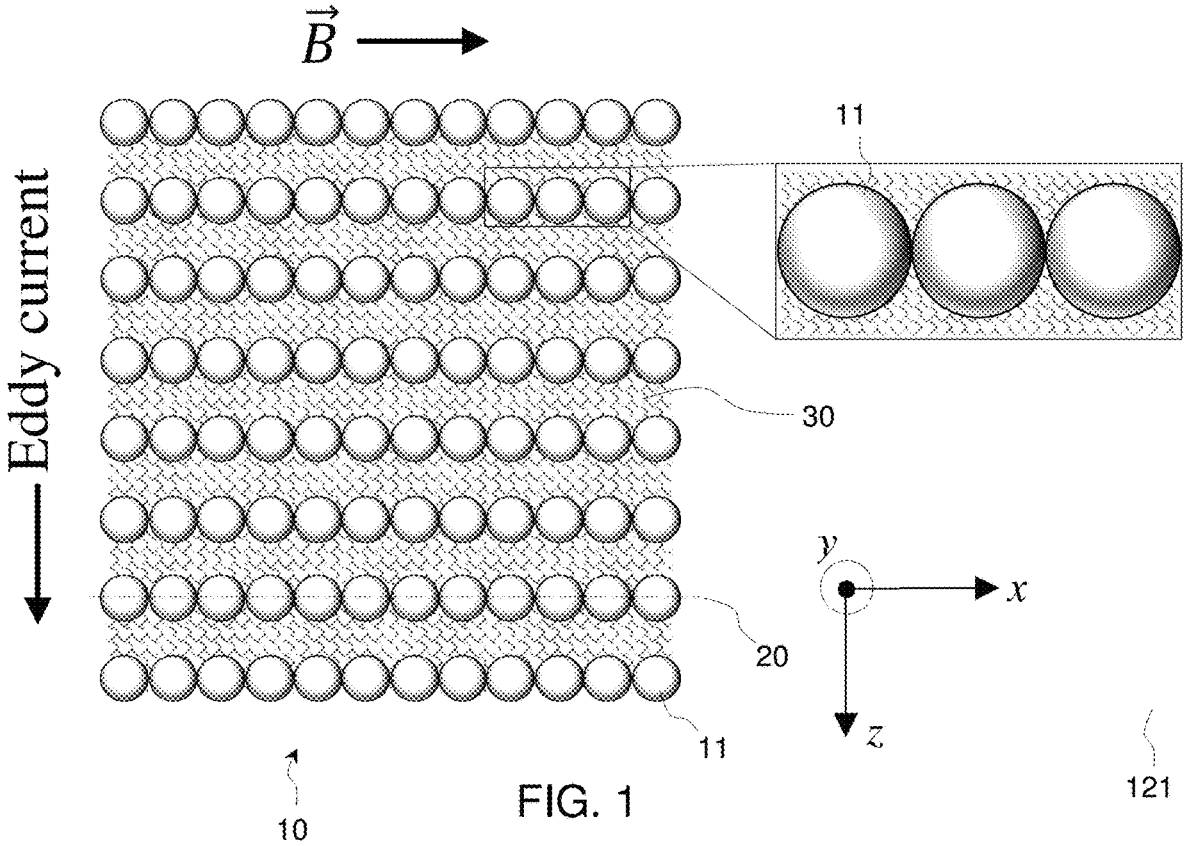
FIG. 1 is a top view illustrating particle chains as formed in a magnetic core, according to embodiments.

The accompanying drawings shown in FIGS. 1, 2A, 2B, and 4-6 show simplified representations of devices or parts thereof, as involved in embodiments. In particular, the particle chains depicted in FIGS. 1, 2A, 2B, 4, and 5 are schematically represented, on purpose. Technical features depicted in the drawings are not necessarily to scale. Similar or functionally similar elements in the figures have been allocated the same numeral references, unless otherwise indicated.

DETAILED DESCRIPTION

In reference to FIGS. 1-5, an aspect of the invention is first described, which concerns a magnetic core 10, 10*a*, 10*b*. Note, numeral references 10*a*, 10*b* refer to variants to the core 10. While features of the present magnetic cores are mostly described in reference to the core 10 of FIG. 1 or 2A-2B, it will be apparent to the one skilled in the art that the cores 10*a*, 10*b* may include similar features.

Basically, the core 10 comprises an anisotropic, composite material, which includes a matrix material 30, as well as magnetically aligned, ferromagnetic particles 11, 12.

Figure 2A:
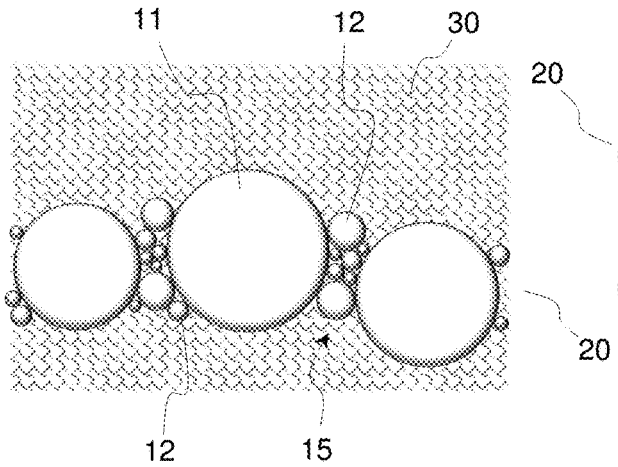
FIGS. 2A and 2B depict necking bridges formed between particles of chains as shown in FIG. 1, as involved in embodiments.
Figure 2B:
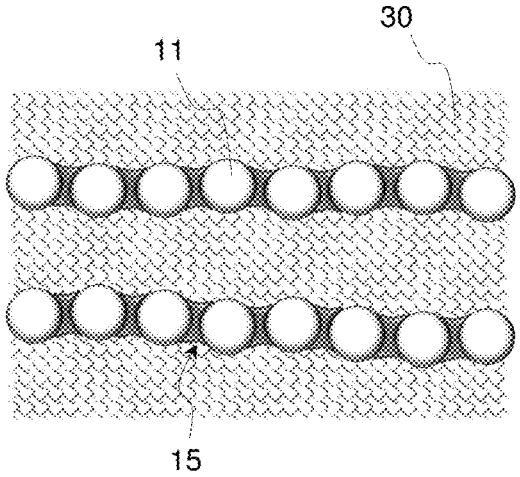
Figure 3:
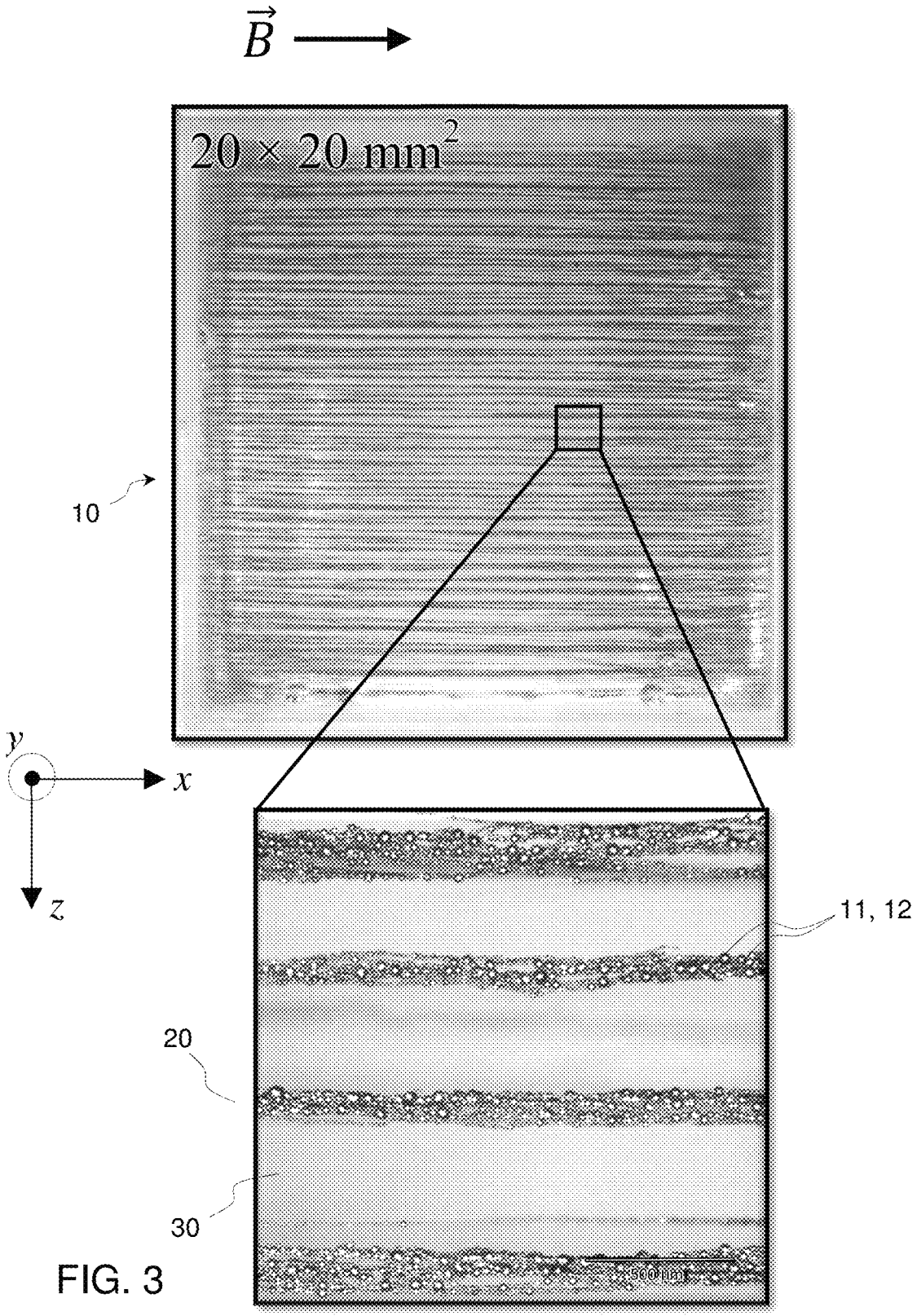
FIG. 3 is a microscope photograph of an actual core, including linear chains as in FIG. 1, and according to embodiments.

As seen in FIGS. 1-3, such particles 11, 12 form chains 20 of particles in the matrix material 30. Such chains 20 form percolation paths of magnetic conduction. The conduction paths extend along a first direction (parallel to axis x in FIGS. 1-2A, 2B). That is, each of the chains 20 forms a conduction path and thus extends along that first direction. Conversely, the chains are distinct and thus distant from each other, along a second direction (parallel to axis z in FIGS. 1-2A, 2B) that is perpendicular to the first direction.

In other words, the magnetically aligned particles 11, 12 form distinct chains 20 that ensure percolation paths extending along a first direction. Such chains extend along the direction of the magnetic field applied during the fabrication, as discussed later in reference to another aspect of the invention. As a result, the chains are substantially parallel to this first direction, while being distinct and thus distant from each other along a perpendicular direction.

The magnetic alignment of the particles 11, 12 translates into a recognizable pattern of aligned particles. I.e., while not being perfectly aligned, a clear alignment direction can nevertheless be observed, together with distinct chains, see FIG. 2A, 2B. And as further seen in FIG. 2A, 2B, each chain 20 may actually involve links consisting of small 3D clusters of particles 11, 12, contrary to the "ideal" depiction of FIGS. 1, 2B, 4, and 5, which suggest links formed by single particles 11. Thus, a "chain" of particles as used herein should be interpreted in a broad sense, such as a filament or a thread of particles 11, 12, i.e., as a longitudinal, composite structure (e.g., having a locally distorted cylinder-like envelope) formed by ferromagnetic particles 11, 12. Particle chains can for example include multiple particles in a direction perpendicular to the percolation path, as seen in FIG. 3, while remaining distant to each other.

Figure 4:
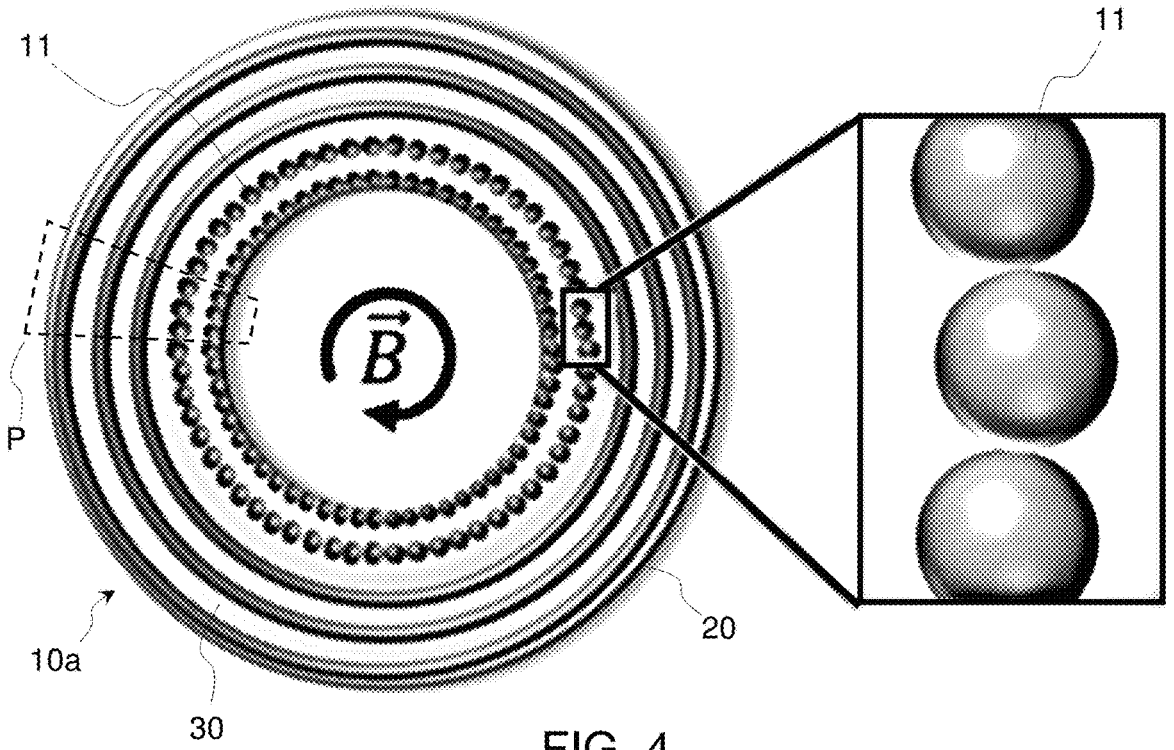
FIG. 4 is a top view of a variant to the linear configuration of the device of FIG. 1.

This first direction may be a straight line, parallel to a given axis (e.g., axis x), yielding a configuration of parallel lines, as assumed in FIGS. 1-2A, 2B. In other cases, the first direction can also be curvilinear (owing to the magnetic field applied during the fabrication), leading to chains that nevertheless remain parallel, as assumed in FIG. 4. Note, at the level of a radial portion P (such as shown in FIG. 4) of the core 10*a*, the chains can be regarded as extending parallel to a same, approximately straight direction. In general, the applied magnetic field may be designed so as for the chains 20 to be substantially arranged according to a desired pattern, e.g., a configuration of concentric tori (as in FIG. 4), a racetrack configuration, or a parallel line configuration (as in FIG. 1 or 5).

The present solution relies on a magnetic assembly of particles 11, 12 in a matrix material 30. Percolation of particles is imposed in the direction in which the magnetic field is applied during the fabrication, while being suppressed (or at least substantially mitigated) in a perpendicular direction. This, as one may realize, enhances the effective permeability in the direction of the applied magnetic field, while suppressing (or at least mitigating) eddy currents in the perpendicular direction. I.e., the magnetic flux is enhanced along the chain's direction, whereas Eddy currents are reduced in the perpendicular direction, hence the importance of the anisotropic percolation. Note, a percolation path implies sufficient mechanical contact between ferromagnetic parts of the particles 11, 12, so as to allow magnetic conduction (i.e., the magnetic resistance at the contact point is low).

Figure 5:
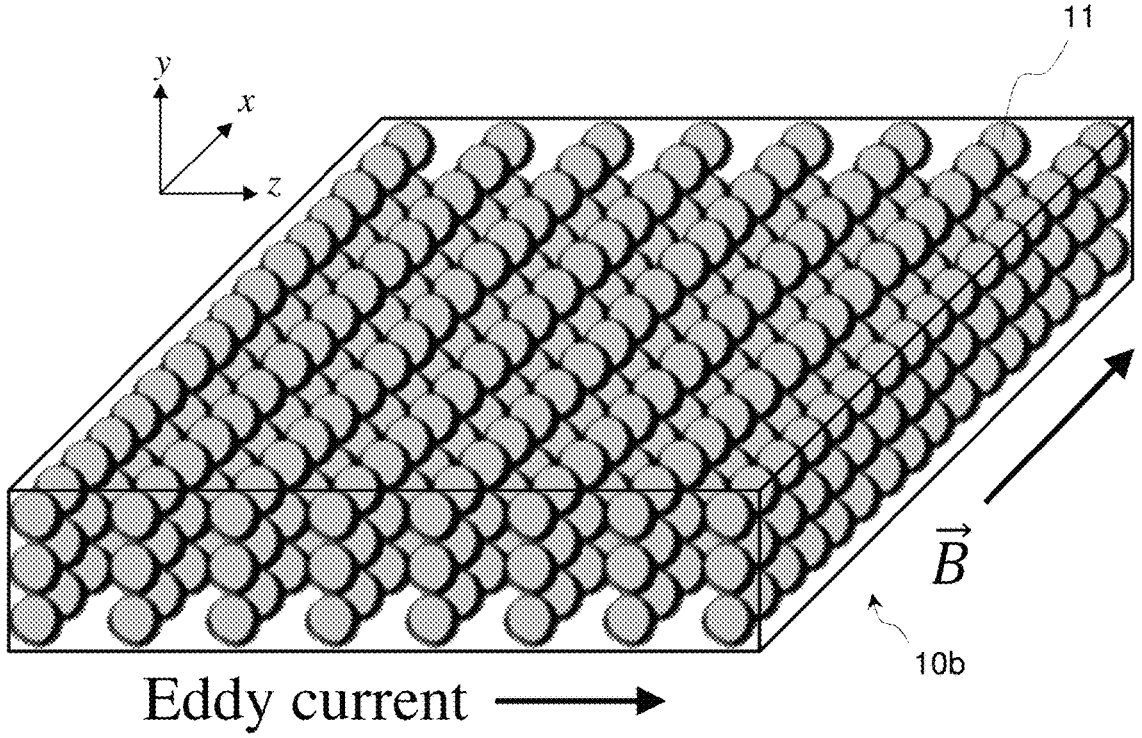
FIG. 5 is a 3-dimensional (3D) view of another variant of a magnetic core, wherein the chains involve percolation paths in two perpendicular directions, though not between parallel rows of chains, as in embodiments.

Interestingly, percolation paths of magnetic conduction may possibly extend along two perpendicular directions, as illustrated in the core 10*b* of FIG. 5, i.e., along the first direction x and a third direction (parallel to axis y in FIG. 5) that is perpendicular to both the first direction and the second direction. Thus, chains of particles form parallel rows of chains. Such configurations were found to provide best results in terms of effective permeability, according to tests performed by the Inventors. A magnetic core 10*b* such as shown in FIG. 5 can be fabricated layer by layer (in y direction), as discussed later. Again, it should be kept in mind that the depiction of FIG. 5 is schematical; real chains will, in practice, rather look like chains seen in FIG. 3.

In all cases, the present approach allows a fast and low-cost fabrication process, especially when compared to thin-film microfabrication processes. The resulting magnetic cores 10, 10*a*, 10*b* can be used in various applications, e.g., to electromagnets, transformers, amplifiers, power-supply devices, electric motors, generators, inductors, magnetic tape heads, and other magnetic assemblies.

All this is now described in detail, in reference to particular embodiments of the invention. To start with, the ferromagnetic particles 11, 12 preferably comprise micrometer-length scale particles. Micro-scale (e.g., spherical and/or rod-like) particles can be used at various loading concentrations. As the present inventors observed, composites obtained based on such microparticles provide stable permeability over a wide frequency range.

Micrometer-length scale particles are particles whose characteristic dimension (e.g., their average diameter for spheroidal particles or average cross-sectional diameter for rod-like particles) is in the micrometer-length range, i.e., between 1 μm and 100 μm. In variants or in addition to micro-scale particles, particles in the sub-micrometer range may be used, e.g., in the nanoscale range (with characteristic dimensions between 1 and 100 nanometers). Preferred, however, is to primarily rely on micro-particles. Yet, additional, e.g., nanoscale, particles 12 shall preferably be used, in addition to micro-scale particles 11, for reasons explained below.

Figure 7:
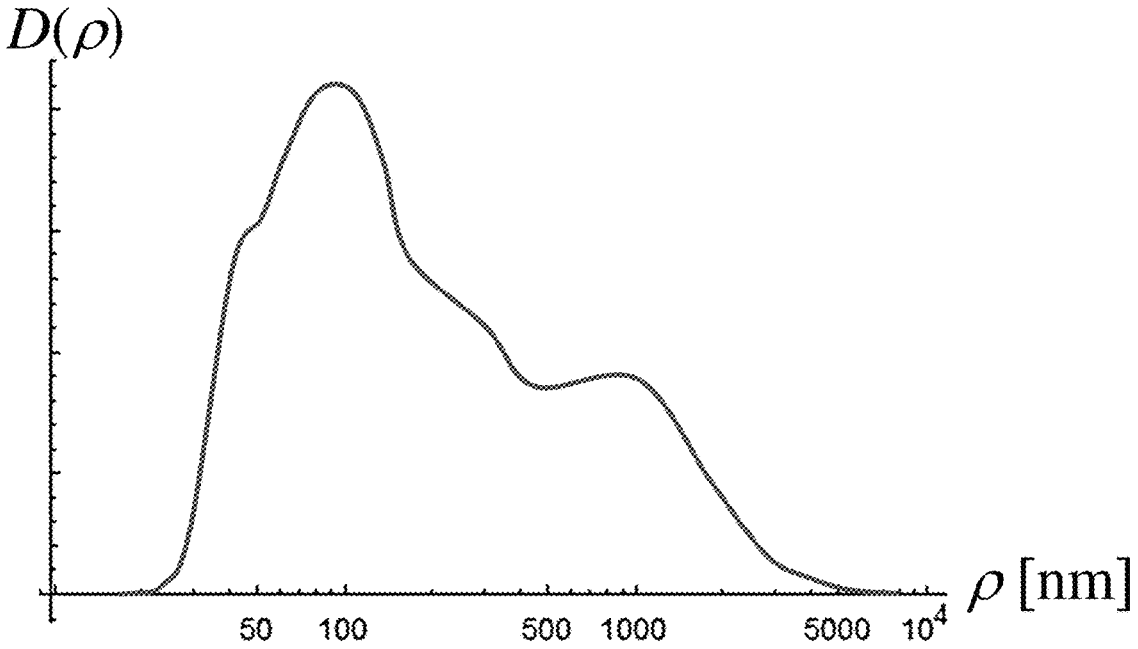
FIG. 7 is a plot representing a possible, multimodal distribution of the ferromagnetic particle sizes, in a magnetic core according to embodiments.

For example, referring to FIGS. 2A, 2B, the particles 11, 12 may include first particles 11 (i.e., particles of a first type) and second particles 12 (of a second type), wherein the second particles 12 have a smaller average diameter than the first particles 11. As seen in FIG. 2A, the second particles 12 may form necking bridges 15 between the larger particles 11, thereby bridging the particles 11 along the first direction (see also FIG. 2B). As noted earlier, the necking bridges 15 between the first particles (e.g., microparticles) are preferably achieved by introducing nanosized ferromagnetic particles into the composite material 30. The dimensions of the first 11 and second particles 12 are typically distributed according to a bi- or multi-modal distribution, as illustrated in FIG. 7, where D(ρ) represents the distribution of the average diameter ρ of the particles. Of course, different distributions can possibly be contemplated, e.g., extending to larger particle sizes.

The second particles 12 may accordingly form a neck 15 around contact regions of the first particles 11, which confers additional mechanical stability to the entire percolation paths. All the more, the second particles 12 may form additional percolation paths of magnetic conduction, as illustrated in FIG. 2A. This enhances the permeability by providing a lower reluctance path of the magnetic field at the points of contact of the microparticles. Necking may for instance be achieved automatically, upon applying the magnetic field, owing to fringing and constricting fields as caused by the particle assemblies upon applying the magnetic field.

Note, the necking bridges 15 too are anisotropic—they are imposed in the direction of the magnetic field (along the paths) and suppressed in the perpendicular direction (no necks are formed between particles of distinct chains). The distance between the chains will typically be larger than (or on the same order of magnitude as) the diameter of the largest particles (e.g., the micron-sized particles). This distance depends on the volume fraction of particles.

While necking bridges can already be obtained thanks to suitably applied magnetic fields, a sintering process can additionally be contemplated, to improve both the mechanical stability and the magnetic conduction. To that aim, the particles 11, 12 will preferably have an average sintering temperature that is substantially less than the melting temperature of the host material 30. For example, permalloys (nickel iron) particles can be used, which have a melting temperature of about 1450 C but can be sintered at 200 C in case of nano-particles. Such a sintering process, however, is optional, inasmuch as particles may be immobilized in the matrix material and thus stay in contact, e.g., by curing the matrix material.

In that respect, the host (matrix) material 30 is preferably a dielectric, non-magnetic material, or a paramagnetic material. Diamagnetic materials should preferably be avoided, while ferromagnetic materials are in principle excluded. For example, the matrix material 30 may consist of or include an epoxy material. It may notably be an epoxy-based negative photoresist, such as a SU-8 polymer or a thermal curable epoxy. Silicone resins and other binder material may also be used. More generally, other materials may be contemplated, such as photoresist materials and photosensitive binder photopolymers.

Various types of ferroelectric materials may be considered to produce the particles 11, 12, starting with materials comprising transition metal elements (Fe, Co, Ni), such as transition metal-metalloid alloys, as well as rare-earth magnets. Suitable particles 11, 12 are commercially available as micro- or nano-particles. Micro-particles are preferably produced by thermal spray processing and nano-particles by plasma spray or liquid precipitation processes.

In practice, the magnetic core 10 may comprises between, e.g., 10 and 50 volume percent (vol %) of ferromagnetic particles 11, 12. This percentage reflects the composition of the core 10, comprising the matrix material 30 and the ferromagnetic particles 11 of the first type and, if necessary, the particles 12 of the second type. It corresponds to the volume fraction of all ferromagnetic particles multiplied by 100. I.e., a fraction of 50 vol % means a mixture of 50 volume units of ferromagnetic particles 11, 12 of either type or both types with enough matrix material 30 (as well as additional materials, if necessary), in order to make a final volume of 100 units. While slightly larger volume fractions may possibly be contemplated, the volume fraction of ferromagnetic particles 11, 12 need normally be limited in order to prevent percolation in unwanted directions. Preferably, the volume fraction of ferromagnetic particles 11, 12 is between 30 and 45 vol %. For example, a volume fraction of 38 vol % is assumed in FIG. 2A-2B.

The thickness of the cores 10 will likely be less than one (or a few) millimeter(s) and may be as small as 100 μm, if necessary, e.g., when molded in structured templates. The samples may else possibly be thinned down, mechanically and/or chemically, if necessary. The lateral dimensions (lengths and widths) of the samples 10 will typically be larger, e.g., in the millimeter up to the centimeter range, depending on the application sought.

Figure 6:
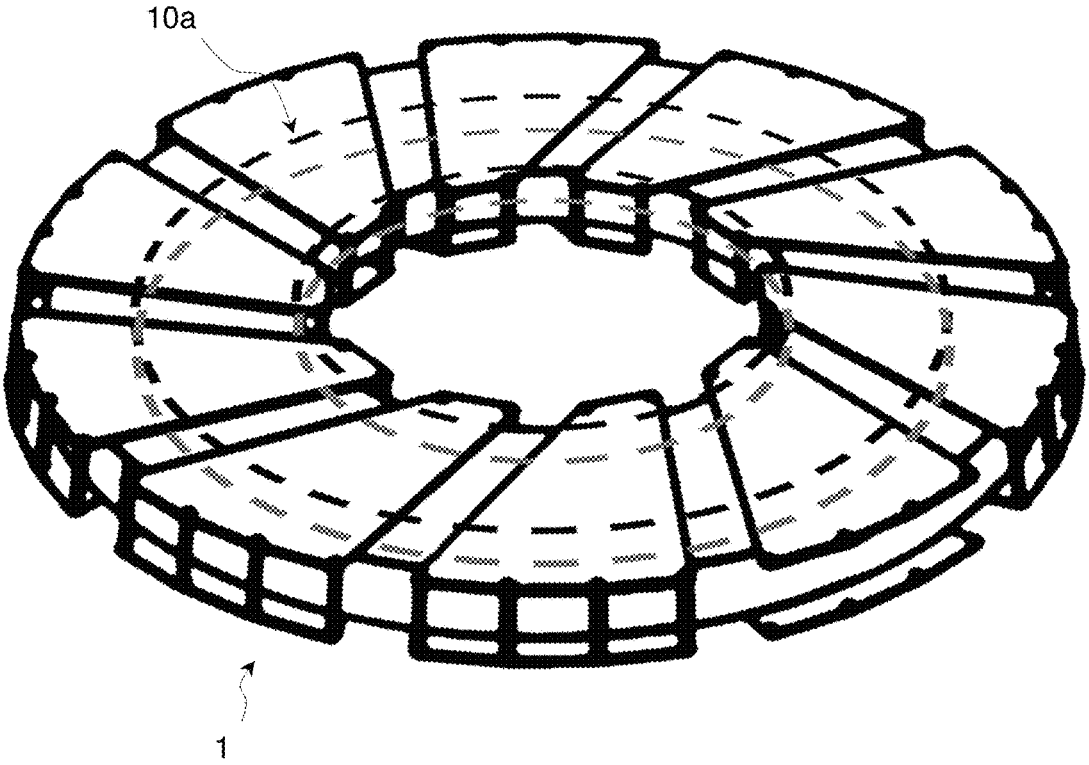
FIG. 6 is a 3D view of a toroidal inductor, including a magnetic core, according to embodiments.

Referring more specifically to FIG. 6, another aspect of the invention is now described, which concerns a magnetic device 1 or apparatus comprising a magnetic core 10, 10*a*, 10*b* such as described above. I.e., the core comprises an anisotropic, composite material including both a matrix material 30 and magnetically aligned, ferromagnetic particles 11, 12 assembled into chains 20 that form percolation paths of magnetic conduction, as discussed earlier. In embodiments, such devices can notably be implemented as inductors, transformers, amplifiers, or power-supply devices. I.e., various applications can be contemplated, including power supplies in servers, microservers, data centers, e.g., for cloud computing, as well as integrated voltage regulators, e.g., for Internet of Things applications. Such magnetic devices can further be implemented as miniaturized transformers for isolation in various information technology, automotive, and aerospace applications, or as miniaturized inductors for resonant circuits for use in various applications such as transceivers, for example.

FIG. 6 shows an example of implementation of such a device 1 as a toroidal inductor, based on printed circuit board (PCB) technology, e.g., for use in an integrated voltage regulator. The inductor leverages free space inside the PCB to host a magnetic core 10*a* such as depicted in FIG. 4. The winding typically involves PCB metal traces and through-vias. The magnetic core 10*a* is embedded in a cavity formed inside the PCB. Manufacturing limitations will typically impose an upper limit to the core thickness, e.g., of a few millimeters. As known per se, two sides of the PCB can be used to mount electronic components, or one side can be exploited for cooling purposes.

Figure 8:
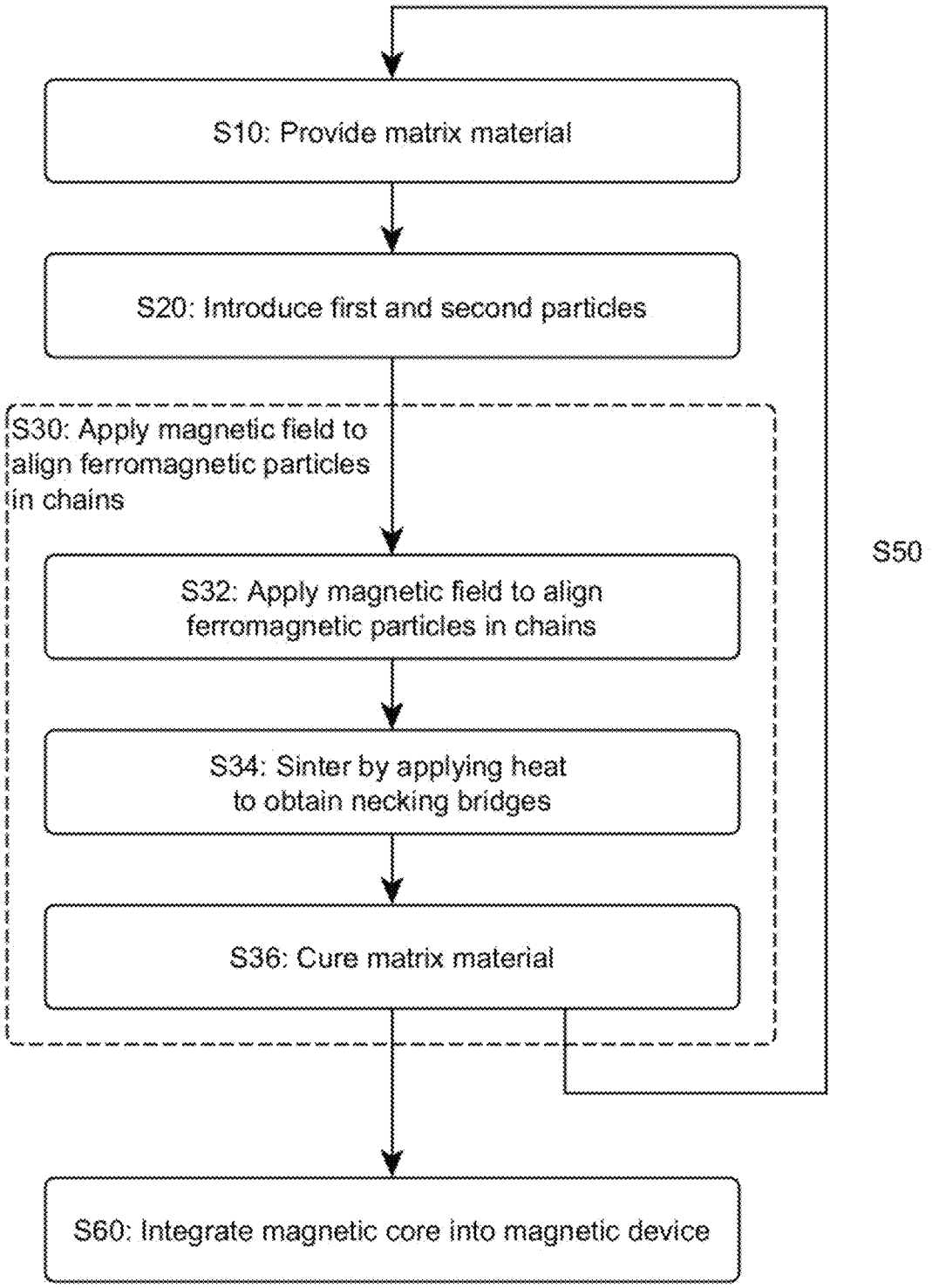
FIG. 8 is a flowchart illustrating high-level steps of a method of fabrication of a magnetic core, according to embodiments.

Referring now to FIG. 8, a final aspect of the invention is described, which concerns a method of fabrication of a magnetic core 10, 10*a*, 10*b*, as described earlier in reference to FIGS. 1-5. Aspects of this method have already been implicitly described; they are only briefly described in the following.

In an embodiment, this method relies on a matrix material 30, provided at step S10 in the flowchart of FIG. 8. This material 30 may already include ferromagnetic particles 11, 12. In variants, the ferromagnetic particles 11, 12 may be introduced in the matrix material 30, e.g., after having filled the latter in a cavity, as assumed in the flowchart of FIG. 8, step S20. A magnetic field is subsequently applied S30 to magnetically align the ferromagnetic particles 11, 12 in the matrix material 30. As explained earlier, this is performed so as to obtain an anisotropic, composite material for the magnetic core 10, in which chains 20 of ferromagnetic particles 11, 12 are formed within the matrix material 30. The chains 20 form percolation paths of magnetic conduction extending along a first direction, whereby the chains 20 extend, each, along the first direction, while being distinct and distant from each other along a second direction that is perpendicular to the first direction.

The magnetic field is typically applied S32 using permanent magnets and/or one or more electromagnets. For example, permanent (dipole) magnets can be arranged on each side of a sample holder, on which the matrix material is placed, prior to introducing or after having introduced the particles. E.g., the magnetic field of a cylindrical dipole magnet may be used, which has a gap of near-constant field in its center, to align the particles 11, 12. In variants, a similar field configuration may be obtained from stacked current loops. Other variants rely on electromagnets (e.g., horseshoe magnets), which could in fact be used in addition or variants to permanent magnets. In all cases, the magnetic field lines should preferably be aligned with the gravitational field direction, to avoid magnetic field interferences distorting the chains 20. Another, less preferred, possibility is to rotate the system composed of the sample, sample holder, and magnets in the gravitational field, during the chain formation and immobilization. Thus, it is possible to cope with the gravitational field during the fabrication, to minimize or, on the contrary, exploit its impact on the chains 20 to obtain a desired chain design. However, the gravitational effects should, in principle, only have a minor impact on the chain geometry.

As said, the particles 11, 12 introduced at step S20 preferably comprise micro-particles 11, possibly complemented with nanoparticles 12. The ferromagnetic particles 11, 12 introduced in the matrix material 30 will preferably represent between 10 and 50 volume percent of the composite material eventually obtained. Typically, a strength of at least 20 mT is needed for the applied magnetic field, in order to obtain the desired chains 20.

Assuming that particles 11, 12 include ferromagnetic particles 12 of smaller average diameter than the first particles 11, the method may further comprise forming S34 necking bridges 15 between the first particles 11. The bridges are formed while applying S32 the magnetic field, so as to bridge the first particles thanks to the second particles 12 and, this, along the first direction. As explained earlier, the chains 20 nevertheless remain unconnected (or not connected) along the perpendicular direction.

Necking can be achieved thanks to the sole magnetic field applied S32 during the fabrication, which leads to fringing and/or constricting fields at the level of the contact regions. The necking is anisotropic as it is imposed in the direction of the applied magnetic field, while being suppressed (or at least mitigated) in the perpendicular direction. As previously discussed too, a sintering process S34 is preferably involved, to strengthen the conduction paths. I.e., the necking bridges 15 may be perfected by sintering S34 the first and second particles 11, 12, by applying heat, and so as to compact the particles and form chains 20 percolating, as possible, along the first direction. Sintering is performed while the magnetic field is still on. The particles 11, 12 are normally sintered S34 at a temperature that is substantially less than the melting temperature of the matrix material 30.

Eventually, the chains 20 may need be immobilized S36 in the anisotropic, composite material obtained. This is typically achieved by curing the matrix material (e.g., by cross-linking a photopolymer or a thermally curable epoxy), while the magnetic field is still on. More generally, the immobilization may be achieved by heating the matrix material, while maintaining the magnetic field.

In embodiments, the matrix material is provided in a structured template (e.g., formed on a surface of the device 1), so as to constrain the shape of the composite material eventually formed. E.g., one or more microfabricated grooves, cavities, etc., can be used for constraining the eventual shape of the composite material 11, 12, 30, as a whole, in specific directions. As said, thicknesses down to 100 μm can be achieved, while lateral dimensions can be much larger (up to millimeters to centimeters in practice).

If necessary, the anisotropic, composite material is formed as a layer-by-layer process, i.e., by successively forming layers of the composite material, which can for instance easily be achieved by repeating S50 steps S10-S36 as described above. A core 10*b* as shown in FIG. 5 may for instance be produced using such a layer-by-layer process. That is, chains 20 of particles may be obtained, which extend along a first direction x but are distant from each other in a second, perpendicular direction z, and which form percolation paths of magnetic conduction extending along both the first direction x and a third direction y, where the latter is perpendicular to both the first direction x and the second direction z, for improved properties.

Eventually, the core materials obtained S36 may for example be packaged for shipment or integrated S60 in specific-purpose devices 1 such as described above, using usual fabrication techniques for such devices.

While the present invention has been described with reference to a limited number of embodiments, variants and the accompanying drawings, it will be understood by those skilled in the art that various changes may be made and equivalents may be substituted without departing from the scope of the present invention. In particular, a feature (device-like or method-like) recited in a given embodiment, variant or shown in a drawing may be combined with or replace another feature in another embodiment, variant or drawing, without departing from the scope of the present invention. Various combinations of the features described in respect of any of the above embodiments or variants may accordingly be contemplated, that remain within the scope of the appended claims. In addition, many minor modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims. In addition, many other variants than explicitly touched above can be contemplated. For example, other materials than those explicitly mentioned may be contemplated, provided they exhibit the required magnetic properties. Additional materials may be used, if necessary, to tune chemical (e.g., cross-linking properties of polymer chains) or mechanical (e.g., rheology, viscosity, etc.) properties of the composite material.

What is claimed is:

1. A magnetic core comprising:

an anisotropic, composite material including at least:

a matrix material; and magnetically aligned, ferromagnetic particles forming chains of said particles within said matrix material, the chains forming percolation paths of magnetic conduction extending along a first direction, whereby the chains extend, each, along the first direction, while being distinct and distant from each other along a second direction that is perpendicular to the first direction, wherein said chains of said magnetically aligned, ferromagnetic particles are arranged in a concentric tori or a racetrack configuration.

2. The magnetic core according to claim 1, wherein said particles comprise micrometer-length scale particles.

3. The magnetic core according to claim 1, wherein said particles include first particles of a first type and second particles of a second type, the second particles having a smaller average diameter than the first particles, and the second particles form necking bridges between the first particles along the first direction.

4. The magnetic core according to claim 3, wherein said first particles comprise micrometer-length scale particles, while said second particles comprise nanometer-length scale particles.

5. The magnetic core according to claim 3, wherein said first particles and second particles have an average sintering temperature that is less than a melting temperature of the matrix material.

6. The magnetic core according to claim 1, wherein said matrix material is a dielectric, non-magnetic material.

7. The magnetic core according to claim 1, wherein said composite material comprises between 10 and 50 volume percent of ferromagnetic particles.

8. A magnetic core comprising:

an anisotropic, composite material including at least:

a matrix material; and magnetically aligned, ferromagnetic particles forming chains of said particles within said matrix material, the chains forming percolation paths of magnetic conduction extending along a first direction, whereby the chains extend, each, along the first direction, while being distinct and distant from each other along a second direction that is perpendicular to the first direction, wherein said matrix material is a paramagnetic material.

9. The magnetic core according to claim 8, wherein said chains are substantially arranged according to one of: a parallel line configuration, a configuration of concentric tori, and a racetrack configuration of the chains of particles.

10. The magnetic core according to claim 8, wherein said chains of the particles form percolation paths of magnetic conduction extending along both the first direction and a third direction that is perpendicular to both the first direction and the second direction.

11. A magnetic device comprising a magnetic core, the magnetic core comprising:

an anisotropic, composite material including at least:

a matrix material; and magnetically aligned, ferromagnetic particles forming chains of said particles within said matrix material, the chains forming percolation paths of magnetic conduction extending along a first direction, whereby the chains extend, each, along the first direction, while being distinct and distant from each other along a second direction that is perpendicular to the first direction, and wherein said matrix material is a paramagnetic material.

12. The magnetic device according to claim 11, wherein the device is one of: an inductor, a transformer, an amplifier, and a power-supply device.

* * * * *